United States Patent [19]

Beckham

[11] 4,257,493

[45] Mar. 24, 1981

[54] HOISTING SYSTEM

[75] Inventor: David E. Beckham, Ferguson, Mo.

[73] Assignee: Unidynamics/St. Louis, Inc., St. Louis, Mo.

[21] Appl. No.: 909,505

[22] Filed: May 25, 1978

[51] Int. Cl.[3] ..... B66B 11/04

[52] U.S. Cl. ..... 187/20; 212/251

[58] Field of Search ..... 187/20, 23, 27, 26, 187/22, 95, 81; 254/139, 167, 190 R; 226/189; 212/40

[56] References Cited

U.S. PATENT DOCUMENTS

| | | | |
|---|---|---|---|
| 396,430 | 1/1889 | Reichel | 187/23 |
| 749,193 | 1/1904 | Hiss | 187/23 |
| 1,073,700 | 9/1913 | Neenan | 187/27 |
| 2,504,206 | 4/1950 | Kunzelman | 187/27 |
| 2,572,165 | 10/1951 | Locki | 187/20 |

FOREIGN PATENT DOCUMENTS

| | | | |
|---|---|---|---|
| 1234957 | 12/1964 | Fed. Rep. of Germany | 187/27 |

*Primary Examiner*—David A. Scherbel
*Assistant Examiner*—Kenneth Noland

[57] ABSTRACT

A hoisting system for use in elevating personnel or other materials preferably within a mine, or other low level installations, incorporating a capsule which is suspended by a singular cable that is fed out from a winding drum, a tension weight suspended below and in alignment with the capsule, being supported by the same cable, and a jib-crane assembly located at the upper reaches of the hoisting assembly to provide for feed out of the cable through its sheave assembly to furnish, at least initially, a lowering of the tension weight to its lowermost extent for coming to rest upon a base, while thereafter the continued unwinding or rewinding of the cable provides respectively for the lowering or raising of the capsule between various levels for effecting transfer of personnel and materials along the shaft heighth.

In the process of operating this hoisting system, the unwinding cable initially lowers the heavier tension weight, due to its weight, first down into the depths of the mine, or the like, until it comes to rest upon the base, and then further unwinding of cable allows for the capsule itself to be lowered stably under the guidance of the singular cable that also embraces its sides, and thereby preventing capsule sway or slack, whereafter the capsule may then be raised or lowered within the shaft under the control of this singular cable.

14 Claims, 4 Drawing Figures

HOISTING SYSTEM

BACKGROUND OF THE INVENTION

This invention relates generally to lifting mechanism and more specifically pertains to a unique hoisting system rendered functional through the agency of a tensioned singular cable means that manipulates a cooperating capsule and aligned tension weight for achieving controlled vertical movement of the capsule between desired levels, as in a mine shaft, after the said weight has been initially rested at the lower reaches of the shaft upon a stable base.

In the prior art, various designs for hoisting mechanisms are provided, and generally have been designed as emergency or escape type of equipment that are useful for rapidly removing personnel from a mine immediately upon notice of an incipient disaster. Usually, and as can be seen from the prior art, such type hoisting mechanisms generally include a capsule, that can be used for holding a particular number of personnel at a time, and which capsule is suspended by a singular cable that is capable of being fed out the full height of the shaft, while at its upper reaches being wound generally upon a drum and which provides during operation for a raising or lowering of the capsule within the shaft. While such an arrangement is effective for providing an emergency removal of personnel from the shaft, the functionality of the hoist due to its simplified construction does present problems during its usage. For example, the capsule of such a hoist, since it is suspended by only a single cable attaching to its top, has a tendency to sway during usage, which can lead to its encountering the sides of the shaft, making the ride rather rough, in addition to potentially leading to possible damage to the system which may eventually cause a deterioration and breakage of its cable. If this occurs, the men laden capsule simply falls the thousand feet or so to the bottom with disastrous results. In addition, the frequent impact encountered by the capsule during its raising or lowering into the shaft can lead to damage to its operative components, such as the winding drum, which is energized by a hydraulic or other type of motor to provide the load withstanding capabilities and for continuity of rewind of the cable as during a lift of the cage. Since a single cable simply suspends the cage of this type of prior art hoist, in the event of breakage of the cable, there is no safety mechanism provided that can prevent a fall of the cage, which means that safety is shunned for the sake of expediency of rapid transfer as during an emergency situation. When breakage does occur, the disaster is compounded not only usually effecting death to those personnel in transit, but at the same time, eliminates the availability of any escape equipment for promptly removing other personnel during an impending emergency situation.

It is, therefore, the principal object of this invention to provide a hoisting system that no only furnishes a rapid removal of personnel as from a mine shaft, or the like, under emergency conditions, but at the same time incorporates built in safety features that prevent any damage or injury to the hoisted personnel in the event of a breakdown of the system itself.

A further object of this invention is to provide a unique system of combining a hoist system capsule and tension weight, the latter being arranged therebelow, and in alignment therewith, wherein the weight is initially lowered to the lower reaches of the mine shaft for resting upon a stable base, and with the further raising and lowering of the capsule being guided by the multireeved singular cable and prevented from swaying through to the stability provided for the system due to the prepositioned tension weight, and the cable further tensioning through the weight of the capsule and its load.

Another object of this invention is to furnish a jib-crane assembly for a hoisting system which may be elevated over the shaftway leading into the mine, or other underground excavation, for positioning of the system for usage, but which likewise may provide for a pivoting of the total mechanism laterally of the shaft for stowage during nonuse.

Another object of this invention is to furnish a unique combination of sheave assemblies operatively associated with the jib and crane assembly, capsule, and the tension weight, so that a singular cable may be multireeved, or at least double reeved, around the combination of these assemblies for providing for both a rapid vertical movement to the capsule during usage, while at the same time the same tensioned cable provides stability and guidance particularly in preventing sway of the capsule or slack in said cable during the rapid elevation or descendency of said capsule within the shaftway of the mine or other facility.

Another object of this invention is to provide a unique means for furnishing manipulation of a singular cable reeved in cooperation with a combined capsule and tension weight, so that the tension weight will be initially moved vertically along the heighth of the shaftway and stably positioned, before the loaded capsule is elevated between desired levels and the top of said way.

Another object of this invention is to provide a relatively simplified system for both raising, lowering, and stabilizing a hoisted capsule through the agency of a single cable.

These and other objects will become more apparent to those skilled in the art upon reviewing the summary of this invention, and upon undertaking a study of its preferred embodiment in view of the drawings.

SUMMARY OF THE INVENTION

This invention envisions the construction and operation of a hoisting system useful for quickly transferring particularly personnel between multiple levels over a significant degree of depth, and to do so with a degree of promptness so as to provide for its use also for evacuation purposes in the event of an emergency. Thus, this invention may be generally identified as an amergency mine escape hoist which incorporates an escape system designed to speed mine personnel to top side safety in a capsule which travels on its own tensioned guide rope or cable at speeds within the vicinity of four hundred feet per minute. The capsule of the hoist is equipped with a tension weight which is initially lowered to the bottom of the air shaft so as to provide a multi-oriented tensioned guide cable that runs the entire depth or length of the shaft. In this manner, the capsule alignment within the shaft is maintained through the establishment of these guide cables which are designed to eliminate capsule swing, sway, slack, or side slapping, during usage, particularly when the capsule is travelling within the vicinity of the velocity as previously explained. When the escape operations from a mine or other low level installation are completed, the capsule and the tension weight are removed, and stowed at the side of the air shaft, which means that the shaft is then completely free of all system components.

The capsule of the hoisting system can be designed to accommodate anywhere from two to eight persons, or even more, depending upon the capsule size, and the capsule is arranged having a sheave assembly mounted at its upper segment, and through which the singular cable of the system is multi-reeved into the configuration desired to attain the attributes desired from this invention. A jib-crane assembly is stably mounted upon the ground within the proximity of the air shaft, and a winding drum installation is arranged proximate thereby so as to feed its cable to and through the jib-crane assembly, and over its arranged sheaves provided upon the mast and at the projecting end of the jib arm means. The sheave assembly of the jib, which may be also identified as the main supporting means for the invention, initially reeves the singular cable therethrough, so that it can extend down towards the sheave assembly as previously explained as provided integrally upon the approximate top of the capsule, and therein pass through a series of aligned sheaves for insuring some safety for the movable capsule, while thereafter the cable is then movably contained downwardly along the side of the capsule so as to provide a means for retention of the capsule within the confinement of the cable, and vice versa, and therein prevent capsule sway or rotation during system usage. Thus, during capsule movement, its weight, and the weight of its occupants, furnishes a sustaining tension upon the singular cable double reeved about the hoisting system, and in this manner provides for its own self guidance so as to prevent its sway in the manner as will be subsequently analyzed. The cable extends downwardly along the approximate side of the capsule, and further downwardly into the depths of the mine shaft, wherein it is reeved once again around a sheave assembly integrally provided upon the upper surface of the significantly heavy tension weight, which as previously explained, is generally arranged in alignment with the vertical axis of the capsule. After the cable's reeving through this particular sheave assembly, it extends upwardly for disposition proximate the diametrically opposite side of the capsule, being movably held thereat, and therein provides a lateral paired cable arrangement, albeit from a singular cable, for providing guidance to the capsule during its movement over the significant depths of the mine shaft, which may be as much as a thousand feet or greater, and therein prevent the said capsule sway and rotation even during its rapid speeds of movement between the bottom, through various levels, or to top side of the shaft as at the ground surface. That segment of the cable that extends further upwardly along the sides of the capsule is multireeved, once again, through additional sheaves provided within the sheave assembly at the approximate top side of the capsule, and the cable thereafter extends upwardly for reeving once again through the sheave assembly provided within the support means of the jib, where it is reeved around one of the sheaves thereat, and then extends downwardly for connecting to a bridle furnished on the canopy of the capsule frame assembly. Thus, the entire configuration of this hoisting assembly, including the variety of sheave assemblies, the capsule, its aligned tension weight, and the jib-crane assembly, are all rendered operative through the agency of a singular cable that is multi-reeved in a particular fashion so as to provide not only the means for rapidly moving the capsule during its usage, but at the same time provide the instrumentality for providing guidance for the capsule for its safe movement throughout the entire height of its operation.

Buffer means are provided upon the upper side of the tension weight so that as the capsule drops downwardly at rapid speeds towards the base supported tension weight, when the capsule finally encounters the lower depth of its destination, the buffer means provided thereat furnishes a cushion against two great of an impact as the capsule encounters this lower level. A limit switch proximate this location provides for a deceleration of the capsule towards its stopping position. Likewise, spring buffer means are provided upon the support means of the jib assembly, so that when the capsule reaches the upper limits of its extent of movement, it will encounter these spring means and be cushioned against any jarring of the capsule, and its occupants, as it reaches top side. Properly positioned limit switches once again can provide for a slow down to a stop in the capsule's travel as it reaches this upper limit. In addition, providing the spring buffer means at this location furnishes a means for two blocking of the capsule at its upper limit, as when it is desired to finally raise the tension weight from its disposition down within the depths of the mine shaft, after an emergency evacuation procedure has been finally completed. At this time, when the capsule is maintained in this upper position, the tension weight may then be raised through the agency of a continued rewinding of the singular cable upon its winding drum until such time as the tension weight once again comes to an elevated position just contiguously under the raised capsule, so that the entire jib-crane assembly may be pivoted some degree, approximately ninety degrees to the side, and bring the entire hoisting assembly into position of rest for stowage.

As previously explained, whereas only a singular cable is necessitated in the winding and support of this capsule and its associated tension weight, various safety means are built into this system so as to insure that should even the cable sustain a breakage, the said safety means will provide for a binding upon the cable at a variety of positions so as to eventually achieve a locking of the capsule with respect to the remaining segments of the cable, and therein arrest its further descent to prevent an impact of the capsule upon the mine floor. This is achieved through the installation of centrifugal type governor safety mechanisms upon the various sheaves, especially that sheave assembly furnished at the upper reaches of the capsule. The actuation of these safety mechanisms have been designed to provide for their locking upon the cable passing through their reeved sheaves when the speed of the capsule exceeds approximately 115% in excess of its rated speed. Obviously other settings for these safety mechanisms can provide for their actuation in the event that a too rapid movement of the capsule occurs while descending within the shaft, but essentially the sheave mounted governors are generally intended to provide for their centrifugal actuation and locking upon the cable passing around the associated sheave in the event that a particular speed is encountered that would indicate either a breakdown in the winding mechanism, or a severance in the cable, generally at that speed which would be indicative of a breakdown in the routine or designed operations of the system.

BRIEF DESCRIPTION OF THE DRAWING

In the drawing, FIG. 1 provides an isometric view of the capsule, jib-crane assembly, and winch house holding the winding drum of this hoisting system invention.

DESCRIPTION OF THE PREFERRED EMBODIMENT

Figure 1:
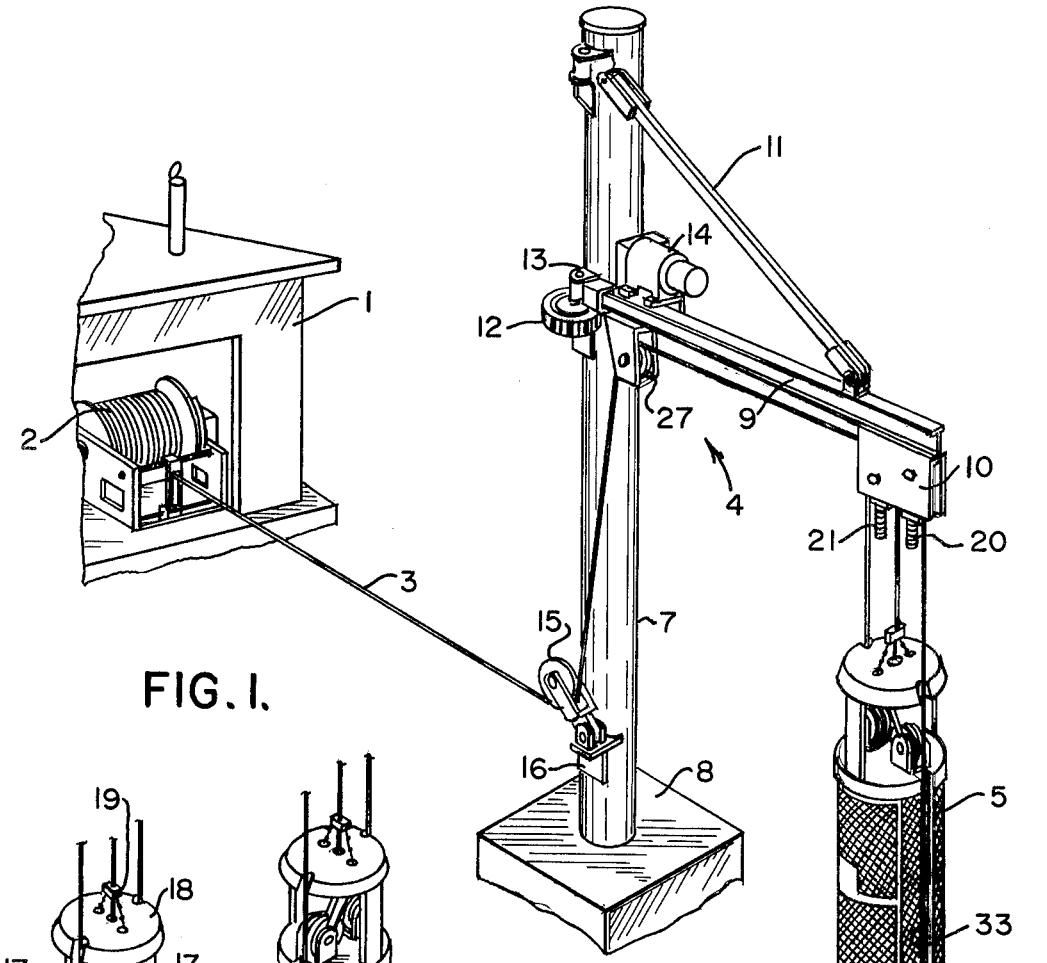

In referring to the drawing, and in particular to FIG. 1, there is disclosed the hoisting system of this invention which includes a winch housing 1, containing its winding drum 2, and for use in feeding out a singular cable 3 to the jib-crane assembly 4 and thence to the capsule 5 of this invention. More specifically, the winch house 1 is designed for holding the type of winding drum 2 or other cable holding means that is effective in providing for controlled feed out or rewinding of the cable 3 at that predetermined velocity desired for the guided travel in vertical movement of the capsule within the air shaft, as at 6, of a mine or other installation in which an emergency hoist of this type is needed and installed. The usual winch for accommodating winding of the cable upon its drum is of the type that can accommodate sufficient cable so as to provide for its unwinding and the descent of the capsule the full depth of the shaft, even after a multi reeving, and likewise must have sufficient capacity for withstanding the significant loads upon the cable so as to insure the safety of the system operation. More specifically, the drum of the winch is sized in accordance with the amount of cable needed for the depth of travel desired, its double reeving, and the weight of the hoist cage and weight, and generally is hydraulically powered with a rated line pull of at least 150% on the first drum wrap. In the preferred embodiment, the winch drum is approximately 24 inches in diameter, minimum, and is in the range of 36 inches wide, but obviously these particular dimensions will vary widely depending upon the size and weight of the capsule arrangement, in addition to the depth and required quantity of cable to furnish the designed range of operation for the system. Once again, in the preferred embodiment, the power source for the winch is a gasoline powered engine which drives a variable displacement axial piston pump, with the pump driving a fixed displacement hydraulic motor that delivers the desired torque to the drum during its functioning. The hydraulic motor output shaft is directly coupled to a spring-applied hydraulic pressure release brake, and the brake is directly coupled to a planetary gear reducer having the proper reduction ratio. The gear reducer is directly attached to the drum and provides the support for its bearing at least at one end. Most of these components are generally incorporated within a winch drum of this type that is customarily used in elevator systems construction, but, the drum of this invention necessitates variable attributes particularly in its size and speed of operation depending upon the load upon the hoisting system desired.

Controller means may also be operativey associated with the drum shaft of this winch, so as to provide for a safety mechanism at that vicinity in the event that the gearing mechanisms within the drum, or its associated power motor, should become inoperative, tending to cause a rapid unwinding of its supported cable, and a descent by fall of the perhaps loaded capsule. These types of controllers are also available in the art, and are useful for this type of purpose.

The jib-crane assembly of this invention incorporates its mast 7, which is secured upon a significantly sized concrete base so as to provide for sturdy support for the entire assembly particularly during its functioning. And, mounted upwardly upon the mast is the jib boom 9, which projects from its mounting proximate one end to the said mast, while at its projecting end secures the support means 10 of this invention which incorporates a series of sheaves for cable handling and accommodating the reeved cable in the manner as will be subsequently analyzed. A brace 11 insures the stable support of the jib 9 with respect to the mast 7, which, as can be appreciated, such type of support is necessitated particularly where the jib of this assembly is pivotally mounted with respect to its mast so as to furnish some slight lateral movement, approximately at a 90° range, so that the capsule 5 can be either indexed in its operative position over the air shaft 6 as shown, or perhaps moved to the side for stowage as when not in use. This pivotal movement is achieved through the arrangement of a gear 12 held by means of the bracket 13 to the mast, while a motor 14, such as a hydraulic gear motor, effectively moves an additional gear (not shown),intermeshing with the said gear 12, so as to furnish the instrumentation for pivoting of the jib 9 between the limits of its designed lateral range.

At the lower segment of the mast 7 is an additional sheave 15, supported thereat by means of the attachment plate 16, with the cable 3 being reeved around the sheave at a predesigned location that is approximately coincident with the jib rotation center line, as when it is shifted by means of the operation of its motor, from its operative to its stowed position at the side of the shaft.

Figure 2:
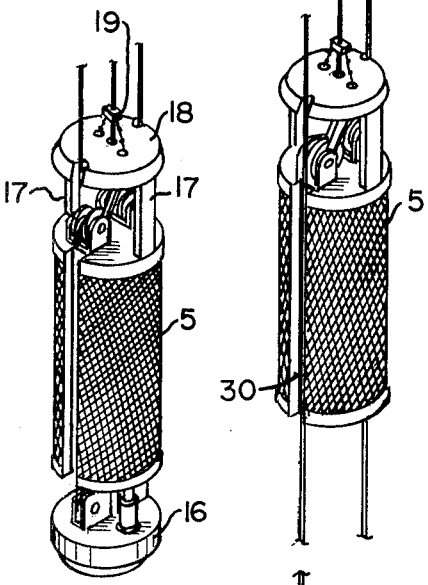
FIG. 2 provides an isometric view of the combined capsule and its aligned tension weight during an approximate two-blocked position as when stowed.

In referring to FIG. 2, the capsule 5 is disclosed having its tension weight 16 aligned contiguously therebelow, as when this combination is readied for stowage, as to the side of the shaft as previously explained. The capsule is of the type to accommodate a variety of personnel, or other material, as previously explained, and includes the various instruments that facilitate the rapid usage of such a device, such as a gate, lights, perhaps telephone, and any other of the usual instrumentalities provided upon such a device. In addition, the cage is designed having expanded metal sides, supported by a steel frame. Furthermore, it is of a significantly lighter weight than its tension weight arranged therebelow, so that movement of the cage relative to its tension weight is not achieved until the tension weight becomes firmly rested upon a stable base, as at the bottom of a mine shaft. In the preferred embodiment, the tension weight, is designed approximately twice the weight of the hoist cage or capsule when supplemented by its live load, as so to achieve the aforesaid desired function during usage of the system. As can be seen, the capsule incorporateas a series of vertical braces, as at 17, and which have an upper canopy 18 arranged spacedly thereabove. Connecting to the top side of the canopy is a safety bridle 19 so as to provide the means for securing of the cable 3 to the said capsule.

Figure 3:
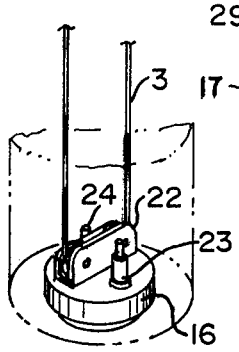
FIG. 3 discloses the relative lowering of the tension weight with respect to its capsule during an installation and usage of the hoisting system.

As can also be seen from the combination of FIGS. 1 through 3, the outboard support means 10 includes a pair of spring buffers 20 and 21 extending downwardly from the same, and which are arranged for being encountered by the canopy 18 as when the capsule reaches the uppermost limit of its travel, and can further provide for a two-blocking of the capsule thereagainst, as when it is finally desired to provide for a raising of the tension weight 16 up from the depths of the shaft 6. In addition, when the capsule reaches this uppermost limit of its travel, said springs have a tendency to suppress against any impact that may be encountered by the capsule when it reaches this uppermost position.

As can also be seen, the tension weight 16 is designed having a sheave assembly 22 rigidly secured thereon, and which is designed for providing for a reeving of the cable 3 therearound, so as to provide for the relative movement of the said weight with respect to the capsule 5 during both system installation and removal, while at the same time providing for cable handling and movement therethrough as when the capsule is being raised or lowered during a common hoisting operation. In addition, and as can be clearly seen from FIG. 3, a pair of buffer means 23 and 24 are secured upon and extend upwardly of the said weight 16, and are of the type that are hydraulically actuated so as to furnish a cushioning against impact when the capsule reaches the lowermost limits of its travel, and comes to rest upon the said weight, as at the bottom of the shaft, or in the alternative, when the tension weight is finally raised out of the shaft and into contiguity with the underside of the capsule in preparation for its pivoting into a stowed position.

Figure 4:
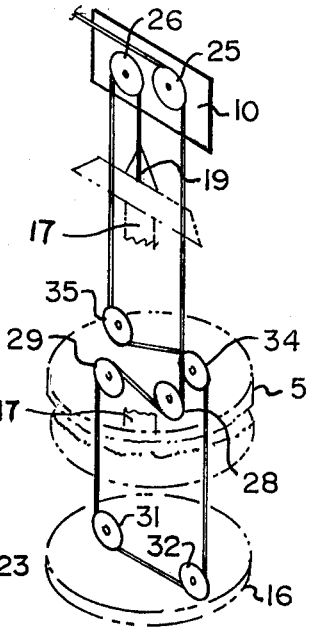
FIG. 4 shows the schematic relationship of the singular cable and its multi-reeving around the sheave assemblies associated with the support means, capsule, and tension weight of this hoisting system.

The reeving of the singular cable 3 about the hoisting system and its various mechanisms of this invention is particularly significant. Essentially, and as previously explained, the cable is designed to furnish initially that instrumentality for raising or lowering of its suspended capsule within the mine shaft, or any other shaft in which it may be located, while secondly, the cable is reeved in a manner that also furnishes guided travel in the capsule movement so as to prevent its sway within the shaft during its rapid transfer at speeds as previously explained. To readily analyze this arrangement, FIG. 4 shows a schematic of the cable and its reeving about the various sheave assemblies of this invention, and as can be seen, the support means 10 contains a pair of outboard sheaves 25 and 26, the first of which receives the cable 3 from the sheave 27 associated with the jib 9, and which cable 3 is reeved around said sheave 25 for extending downwardly towards the upper reaches of the capsule 5. At this location, said cable 3 is double reeved around a pair of sheaves 28 and 29 where it then extends further downwardly along the approximate side of said capsule, particularly within a formed recess provided therealong, as at 30, for further extension downwardly towards the tension weight 16. At this location, the cable 3 then extends around a pair of sheaves 31 and 32, of the sheave assembly 22, for extension once again upwardly along the opposite side of the capsule 5, also within the recess arranged at this location, as at 33, so as to furnish a confining guide for the movement of the cable 3 along the sides of the said capsule. At this location, the cable 3 is once again twice reeved about a pair of sheaves 34 and 35, and then extends upwardly around the sheave 26, of the support means 10, where it is reversed on itself for extension downwardly for connection by means of the safety bridle 19 to the upper side of the canopy 18 of the said capsule 5. Thus, it can be seen that the singular cable 3 is multi-reeved about a variety of sheave assemblies, one associated with the support means 10, another associated with the upper surface of the capsule 5, and the third sheave assembly arranged upon the upper side of the tension weight 16. And, the cable provides guidance for the vertical travel of the capsule 5 along its direction of movement, and prevents any sway due to the double contiguous arrangement of the cable 3 within the formed recesses 30 and 33 provided to either side of the said capsule.

In the operation of the hoisting system of this invention, as was previously briefly explained, the jib crane assembly 4 will be pivoted into that position shown in FIG. 1, having the capsule 5 and its tension weight 16, as shown in FIG. 2, being arranged within a position of alignment above the air shaft 6 as also shown in FIG. 1. Then, due to the unique arrangement in the reeving, preferably double reeving, of the singular cable 3 about the entire system, as shown in FIG. 4, as any cable is initially unwound from the drum 2 during its functioning, and due to the fact that the tension weight 16 is approximately double or more the weight of the capsule 5, any cable initially released will immediately effect only a lowering of the tension weight 16, down into the air shaft 6, with such variable displacement between the capsule 5 and the tension weight 16, as shown in FIG. 3, effecting a lowering of the weight downwardly into the air shaft 6, as the capsule remains stationary above, as also shown in FIG. 1. Further unwinding of the cable 3 from the drum continues the descent only of the tension weight 16, for the entire depth of the shaft, which may be as much as a thousand feet, more or less, as previously explained, until such time as the weight comes to rest solidly upon a base, such as the ground of the mine shaft located therebelow. At this time, the tension weight becomes stable in position, remains taut throughout its entire reeving, and any further feed out of the cable 3 then achieves a gradual descent of the capsule 5, through the effects of its own weight, and as can be determined from the reeving of the cable about the various sheave assemblies 10, 22, and those sheaves provided at the top of the capsule 5, the weight of the capsule 5 itself effects a continuous tension upon the entire cable, which means that the previously discussed positioning of the cable to either side of the capsule sustains the cable's alignment within the recesses 30 and 33, while the capsule continues its descent downwardly into the mine shaft. Thus, the capsule is prevented from swaying during its descent or elevation, due to its cooperation with the located singular cable, while at the same time the capsule moves unemcumbered along the various levels of the shaft during its vertical movement within the mine.

In the event that any breakage should occur in the cable, as during a lowering or raising of the personnel laden capsule 5, the capsule will then momentarily begin to descend at a more rapid rate, as under free fall, at which time the cable will be grasped either by the safety controller mechanism associated with the winding drum 2, and more preferably, through the agency of the safety governors or cable fastening means that are associated with one of the sheaves 28 and 29, and also associated with one of the sheaves 34 and 35, all four of these sheaves being arranged within the sheave assembly located at the upper side of the capsule 5, as previously explained. It might be commented that these broken rope safety type governors that are used in cooperation with the described sheaves are readily available in the art, and can be acquired from such companies as the F. S. Payne Co., located at Cambridge, Massachusetts.

Once the capsule reaches the lowermost position of its desired descent, it may be raised from that position by a simple reversing and rewinding of the drum 2, which causes the cable 3 to retract through the various sheave assemblies, and effect a pull upon the capsule through the agency of its safety bridle 19, so as to raise the capsule upwardly and eventually out of the air shaft 6, and into that position as shown in FIG. 1. At this location, an apron or temorary platform may be provided so as to facilitate the egress of any personnel riding within the capsule 5. And, in the event that all personnel have been safely removed from the shaft, the cable may be continued in its rewinding upon the drum 2 until such time as the upper canopy 18 of the capsule comes into contact against the spring buffers 20 and 21, which effectively achieves a two-blocking of the capsule at this location, with any further rewinding of the cable then effecting a raising of the heavy tension weight 16, up the entire height of the shaft 6, until such time as it comes into a position of contiguity at the underside of the capsule 5, as shown in FIG. 2. In this position, the combined capsule and its tension weight will be both entirely removed from the air shaft 6, and through the operation of the motor 14 associated with the jib-crane assembly 4, the job boom 9 and its suspended capsule 5 may be pivoted some degree, approximately 90 degrees, to the side, and into a position of nonuse as during stowage.

Variations in the construction of this hoisting assembly of this invention, or even the reeving of its singular cable 3, may occur to those skilled in the art upon reviewing the subject matter of this invention. For example, the cable may avoid its reeving through the sheave assembly 28, 29, 34, and 35, and simply by guided directly downwardly from the support means 10 and through the sheave assembly 22, and upwardly again around the sheave 26 for eventual connection to the upper side of the capsule canopy 18. Thus, in this manner, the cable will still provide for the convenient guidance of the capsule during its lift or descent within the shaft, while at the same time provide for the movement of the capsule vertically throughout the entire height of the shaft in the manner as previously described, an independently of its tension weight 16, which will have initially come to rest upon the bottom of the mine shaft to stabilize it, and the entire cable system, for ready usage. In this type embodiment, the safeties may be installed upon the sheaves 25 or 26, or both. In addition, it may also occur to those skilled in the art that this hoisting system may be utilized within other facilities than a mine shaft, as for example, a similar type emergency system of this nature may be incorporated within the ship's hold, or any related installation where a hoisting facility of this nature is currently and commonly utilized.

The subject matter of this invention, as explained herein, is set forth for illustrative purposes only, and any variations as previously described if yet within the spirit of this invention and the scope of the appended claims, are intended to be protected by any patent issuing herein.

Having thus described the invention what is claimed and desired to be secured by Letters Patent is:

1. A hoisting system for use in elevating personnel or the like, comprising, a capsule disposed for approximate vertical movement between various levels, singular cable means operatively associated with the capsule and provided for controlling the movement of the capsule between the desired levels, tension weight means aligned beneath the capsule and suspended by the same singular cable means and disposed for variable movement relative to said capsule particularly during system installation and removal, cable handling means including a sheave assembly provided upon the tension weight means to facilitate the cable transfer during system usage, support means arranged over the capsule and tension weight means and functioning to facilitate the cable transfer, cable handling means including a sheave assembly provided upon the support means to facilitate the cable transfer during system usage, cable handling means including a sheave assembly provided upon the upper side of the capsule to facilitate the cable transfer during system usage, said tension weight means being of substantially greater weight than the weight of the said capsule, whereby during operation of the hoisting system the singular cable means allows the tension weight means to initially descend for placement before the capsule functions to raise or lower between the support means and the tension weight means during continuing feed-out or withdrawal of the singular cable means upon the various sheave assemblies.

2. The invention of claim 1 and wherein said singular cable means operatively cooperates with approximately at least one side of the capsule to prevent its sway during system usage.

3. The invention of claim 2 and wherein said singular cable means operatively cooperates with approximately diametrically opposite sides of the capsule to prevent its sway during system usage.

4. The invention of claim 1 and including said singular cable means being reeved around the support means sheave assembly, said cable means extending downwardly along approximately the side of the capsule, said cable means then being reeved around the tension weight means sheeve assembly, said cable means then extending upwardly along the approximate opposite side of said capsule, said cable means again extending around the support means sheave assembly, and said cable means then attaching to the approximate top of the said capsule.

5. The invention of claim 1 and wherein said cable means is double reeved to the said capsule.

6. A hoisting system for use in elevating personnel or the like, comprising, a capsule disposed for approximate vertical movement between various levels, singular cable means operatively associated with the capsule and provided for controlling the movement of the capsule between the desired levels, tension weight means aligned beneath the capsule and suspended by the same cable means and disposed for variable movement with respect to said capsule particularly during system installation and removal, support means arranged over the capsule and tension weight means, a sheave assembly operatively associated with the support means and provided for facilitating the cable transfer during system usage, cable handling means provided upon the tension weight means, said cable handling means comprising at least another sheave assembly, another cable handling means provided upon the upper side of the capsule, said cable handling means upon the capsule comprising at least a further sheave assembly, said singular cable means being reeved around the support means sheave assembly, said cable means then extending downwardly and being reeved around the capsule means sheave assembly, said cable means then extending downwardly along approximately the side of the said capsule, said cable means then being reeved around the tension weight means sheave assembly, said cable means then extending upwardly along the approximately opposite side of the said capsule, said cable means operatively cooperates with approximately at least one side of the capsule to prevent its sway during system usage, said cable means then extending again around the capsule means sheave assembly, said cable means then extending upwardly and being reeved around the support means sheave assembly, and said cable means then extending downwardly for attachment to the approximate top of the said capsule.

7. The invention of claim 6 and wherein said support means includes a jib-crane assembly, said assembly including a mast, a jib projecting from said mast, and said support means assembly being connected to the projecting end of said jib.

8. The invention of claim 7 and wherein said jib pivotally mounts to said mast, and said jib capable of pivoting between operable and nonoperable positions.

9. The invention of claim 8 and including motor means operatively associated with the jib-crane assembly to effect movement between said positions.

10. The invention of claim 6 and including cushioning means provided upon the support means to alleviate the impact when the capsule reaches the uppermost extent of its vertical movement.

11. The invention of claim 6 and including buffer means provided upon the tension weight means to alleviate the impact when the capsule reaches the lowermost extent of its vertical movement.

12. The process for raising or lowering a capsule of a hoisting system into approximate vertical movement, said capsule of the system being suspended by a singular cable and having a tension weight also supported by said cable and being aligned therebelow for variable movement with respect to said capsule during the system operation, comprising, feeding out the singular cable from a winding drum to first initiate a lowering of the tension weight downwardly into approximate vertical movement while the capsule remains substantially stationary at a raised location, continuing the lowering of the tension weight by feeding out additional of the singular cable until said weight comes to rest upon a base, then continuing the unwinding of the same cable from the drum to initiate the lowering of the capsule after said tension weight encounters its base, thereafter continuing the lowering of the capsule until it reaches the desired level of its descendency while simultaneously discontinuing the cable unwinding from the drum at that particular instance, the capsule of the hoisting system being raised through initiating the rewinding of said singular cable upon the drum, continuing the rewinding of the said cable upon the drum to raise the capsule to the upper limit of its movement while the tension weight simultaneously remains at rest upon its base, thereafter continuing the rewinding of the singular cable upon the drum to initiate and sustain the raising of the tension weight to a position contiguous with the underside of the capsule, and thereafter ceasing any further rewinding of the said cable upon said drum.

13. The process of claim 12 and including continuing the raising and lowering of the capsule between its limits of upper and lower movements through the winding and unwinding of the cable from the drum while the tension weight through its inherent load remains rested upon its base.

14. The process of claim 12 and including shifting the combined raised capsule and tension weight laterally to a position of stowage during nonuse.

* * * * *